US007901156B2

(12) United States Patent
McCue et al.

(10) Patent No.: US 7,901,156 B2
(45) Date of Patent: Mar. 8, 2011

(54) BOLLARD HAVING AN IMPACT ABSORPTION MECHANISM

(75) Inventors: David S. McCue, Manchester, MA (US); Daniel B. Ballou, Salem, MA (US); James F. McKeever, Lynn, MA (US); Thomas C. Fitch, Somerville, MA (US); Teodoro A. Mesa, Lynn, MA (US); Sandra K. Jauron, Boston, MA (US); Brent Hild, Belmont, MA (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 12/652,988

(22) Filed: Jan. 6, 2010

(65) Prior Publication Data

US 2010/0172692 A1 Jul. 8, 2010

Related U.S. Application Data

(60) Provisional application No. 61/142,775, filed on Jan. 6, 2009.

(51) Int. Cl.
*E01F 13/00* (2006.01)
*E01F 9/00* (2006.01)

(52) U.S. Cl. ..... 404/9; 404/6; 404/10

(58) Field of Classification Search ..... 404/6, 9, 404/10; 256/1, 19; 40/608, 612; 49/49; 116/63 R See application file for complete search history.

(56) References Cited

U.S. PATENT DOCUMENTS

| | | | | |
|---|---|---|---|---|
| 1,402,465 | A * | 1/1922 | Wood | 40/608 |
| 3,591,144 | A * | 7/1971 | Iving | 404/6 |
| 3,693,940 | A * | 9/1972 | Kendall et al. | 256/1 |
| 3,980,278 | A * | 9/1976 | Elias | 256/59 |
| 4,290,585 | A * | 9/1981 | Glaesener | 256/13.1 |
| 4,806,046 | A * | 2/1989 | Clark | 404/10 |
| 5,090,348 | A | 2/1992 | Hugron | |
| 5,199,814 | A * | 4/1993 | Clark et al. | 404/10 |
| 5,299,883 | A * | 4/1994 | Arth, Jr. | 404/10 |
| 5,323,583 | A * | 6/1994 | Venegas, Jr. | 52/309.4 |
| 5,452,965 | A * | 9/1995 | Hughes, Sr. | 404/10 |
| 5,597,262 | A * | 1/1997 | Beavers et al. | 404/6 |
| 6,209,276 | B1 * | 4/2001 | Venegas, Jr. | 52/301 |
| 6,213,452 | B1 * | 4/2001 | Pettit et al. | 256/59 |
| 6,769,833 | B2 * | 8/2004 | Dicke et al. | 404/10 |

(Continued)

FOREIGN PATENT DOCUMENTS

| | | | |
|---|---|---|---|
| JP | 08-232219 | A | 9/1996 |
| KR | 20-0195894 | Y1 | 9/2000 |
| KR | 10-2004-008952 | | 1/2004 |

*Primary Examiner* — Thomas B Will
*Assistant Examiner* — Abigail A Risic
(74) *Attorney, Agent, or Firm* — Occhiuti Rohlicek & Tsao LLP

(57) ABSTRACT

A plate-mounted bollard which includes an internal impact absorption mechanism that enables the bollard to absorb impact forces greater than conventional plate-mounted bollards. The bollard makes use of a force transfer process that shifts impact forces to areas better able to resiliently absorb the impact without causing damage to the bollard, the impact absorption mechanism, or the ground in which the bollard is installed. The impact absorption mechanism consists of an internal resilient core rod mounted at its proximal end to a base plate which is fixed to the ground. Impact forces are then transferred through an outer shell to the distal or upper end of the internal resilient core. With energy from the impact force being distributed along the maximum length of the resilient core rod, the rod flexes and the full length of the rod is utilized to absorb the impact energy.

20 Claims, 5 Drawing Sheets

U.S. PATENT DOCUMENTS 7,287,930 B2 * 10/2007 Yamasaki et al. ..... 404/10
2002/0056251 A1 * 5/2002 Venegas, Jr. ..... 52/736.3
2002/0150423 A1 * 10/2002 Dicke et al. ..... 404/10
2005/0196235 A1 * 9/2005 Strick ..... 404/10
2007/0110515 A1 * 5/2007 Appelman ..... 404/6
2008/0179579 A1 * 7/2008 McGinness et al. ..... 256/64

* cited by examiner

BOLLARD HAVING AN IMPACT ABSORPTION MECHANISM

CROSS REFERENCE TO RELATED APPLICATIONS

This application claims the benefit of the priority date of U.S. Provisional application 61/142,775, filed on, Jan. 6, 2009, the contents of which are herein incorporated by reference.

FIELD OF THE INVENTION

The present invention relates to a bollard, and more particularly to a bollard mechanism incorporated therein that transfers impact loads to an upper end of a resilient shaft where impact energy is most efficiently absorbed.

BACKGROUND OF THE INVENTION

In supermarkets and retail stores, floor fixtures such as freezer and refrigerator cases, floor shelving, and product displays, are susceptible to damage due to collisions with shopping carts, floor scrubbers, pallet jacks, stock carts, and the like. For example, freezer and refrigerator cases typically include a glass or transparent plastic door for viewing the product without opening the door. The glass can be shattered, or the plastic scratched, upon impact with shopping carts, or the like. Since the body of many of these floor fixtures is constructed of lightweight aluminum or hardened plastic, it can be easily dented or cracked by such impacts. Likewise, in industrial locations, including warehouses and manufacturing facilities, product storage, doorways, equipment, and the like, are susceptible to damage due to collisions with heavy equipment, such as delivery vehicles, forklifts, and the like.

A bollard protects objects from collisions with things from shopping carts to delivery vehicles or automobiles. Bollards are commonly employed inside a store to block shopping cart access to certain areas and outside a store to protect outdoor structures from collisions, to indicate parking areas, to block vehicle and heavy equipment access to a particular area, and to direct a flow of traffic. Bollards can also be used to block vehicular access for security reasons.

In part due to the diverse applications for bollards, the market has thusfar derived two primary types of bollards, namely, plate-mounted bollards and core-drilled bollards. Plate-mounted bollards conventionally involve a steel plate having three or four bolt holes and a bollard extending perpendicularly from one face of the plate. The plate sits on the floor and bolts are used to fasten the plate, and therefore the bollard, to the floor through the bolt holes. There is no significant disruption to the ground or floor, other than the bolt holes, which are in some instances pre-drilled. On the other hand, core-drilled bollards conventionally require a major disruption to the ground or floor with the creation of a hole 2-4 feet deep and having a larger diameter than the bollard itself (e.g., 8 inches to 2 feet, or larger). Concrete is poured into the hole and the bollard is placed in the concrete and held vertically while the concrete cures. In some instances, concrete is also poured into the hollow bollard itself Installation of a core-drilled bollard is significantly more expensive than with a plate-mounted bollard, and takes significantly more time to complete. However, there are locations where the core-drilled bollard is required due to its ability to absorb larger impacts than the plate-mounted bollard.

The plate-mounted bollards conventionally are utilized in areas where impacts are more likely to be less severe, and involve lighter objects, or where no significant impacts are likely and the bollard serves more as a marker. For example, inside a grocery store in front of a freezer case any impact would likely be from a shopping cart or floor polisher. Such an impact would be considered to be low-energy, or relatively minor. Accordingly, a plate-mounted bollard would be appropriate for this type of installation. Contrarily, in a warehouse with heavy equipment, such as delivery vehicles and forklifts, impacts are more likely to be more severe, or high-energy. A vehicle backing up may accidentally collide with a bollard. Accordingly, a core-drilled bollard would be more appropriate in these types of settings.

There are a substantial number of installations where a conventional plate-mounted bollard does not provide quite enough impact protection; however, a core-drilled bollard is significantly over-sized for the application. Yet, a core-drilled bollard is installed because the conventional plate-mounted bollard falls short of providing the required protection. Likewise, there are installations where a core-drilled bollard is necessary to provide protection against likely impacts, yet a plate-mounted bollard is installed because they are less expensive or there are logistical problems with drilling 4 foot deep holes for the core-drilled bollard installation. One of ordinary skill in the art will appreciate that there are other factors that may influence the selection of a plate-mounted bollard or a core-drilled bollard.

The ability of the conventional plate-mounted bollard to absorb impact energy is, to date, limited by the strength of the three or four bolts holding the plate and bollard in the ground. When a plate-mounted bollard experiences a collision with an object, the impact is absorbed primarily at the intersection between the bollard and the plate to which it is mounted.

Looking at FIG. 1, an example conventional bollard 10 coupled with a plate 12 and mounted to the ground with bolts 14 is illustrated. More specifically, a bollard 10 that is 36 inches high, for example, most often receives impact forces in the first 18 inches off the ground. This is because bumpers of equipment that most often collide with the bollards are typically in that height range. As the bollard receives an impact force ($F_1$), the bollard 10 (which is typically rigid so as to avoid damage from collisions) acts as a lever or moment arm. Due to the rigidity of the bollard, the force ($F_1$) is immediately experienced at an intersection (I) of the bollard 10 with the plate 12, which in turn pulls upward on the bolts 14 holding the plate 12 to the ground. Magnified levels of the impact force ($F_1$) are experienced by the intersection (I) due to the moment arm phenomenon. The bolts 14 are also subject to forces sufficient in some instances to pull the bolts 14 out of the ground. There is no give, or flex, in these rigid plate-mounted bollards to absorb some of the impact forces.

Even with bollards that include some form of spring mechanism internally, if the bollard is mounted to the plate, the impact force ($F_1$) is typically received at the intersection thereof without much absorption of the impact force anywhere else in the bollard structure. If, alternatively, the intersection between the base plate and the bollard is hinged or pivoted and has a spring holding the bollard upward, then such a structure is unable to withstand substantial impact forces without pivoting over on its side, resulting in excessive lateral movement at the upper end of the bollard (if the top of the bollard moves a lot on impact, it may collide with the nearby structure it is supposed to be protecting). Accordingly, in conventional plate-mounted bollards, the force immediately generates a lever scenario where the impact force that results is a greater impact force than can be absorbed by the bolts, the bolts may pull out of the floor, or altogether fracture, or the floor may buckle attempting to withstand the impact.

A core-drilled and cemented bollard withstands such impacts as described above because a greater length of sub-floor bollard and a substantial area of concrete hold the base of the bollard in place. When the ability to absorb a larger impact is required, the convention is to utilize a core-drilled bollard.

Example ranges of impact forces that are typically managed by conventional plate-mounted bollards include ranges of up to about 4000 lbs with maximum lateral movement at the top of the bollard of about 3 inches due to the limitations described above. Example ranges of impact forces that are generally managed by conventional core-drilled bollards include ranges of up to about 16,000 lbs, with no substantial lateral movement of the top of the bollard at impact, or with movement of less than about 1 inch. As can be seen, the core-drilled bollards can manage substantially greater impact forces, but they require significantly more expensive and time intensive installations.

SUMMARY

There is a need for a bollard incorporating a mechanism that can absorb larger impacts than conventional plate-mounted bollards, with lateral movement at the top of the bollard within acceptable ranges, but that does not require the major disruption, time, and expense of the core-drilled bollard, that does not transfer all of the impact forces to plate intersections and mounting fasteners. The present invention is directed toward further solutions to address this need, in addition to having other desirable characteristics.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
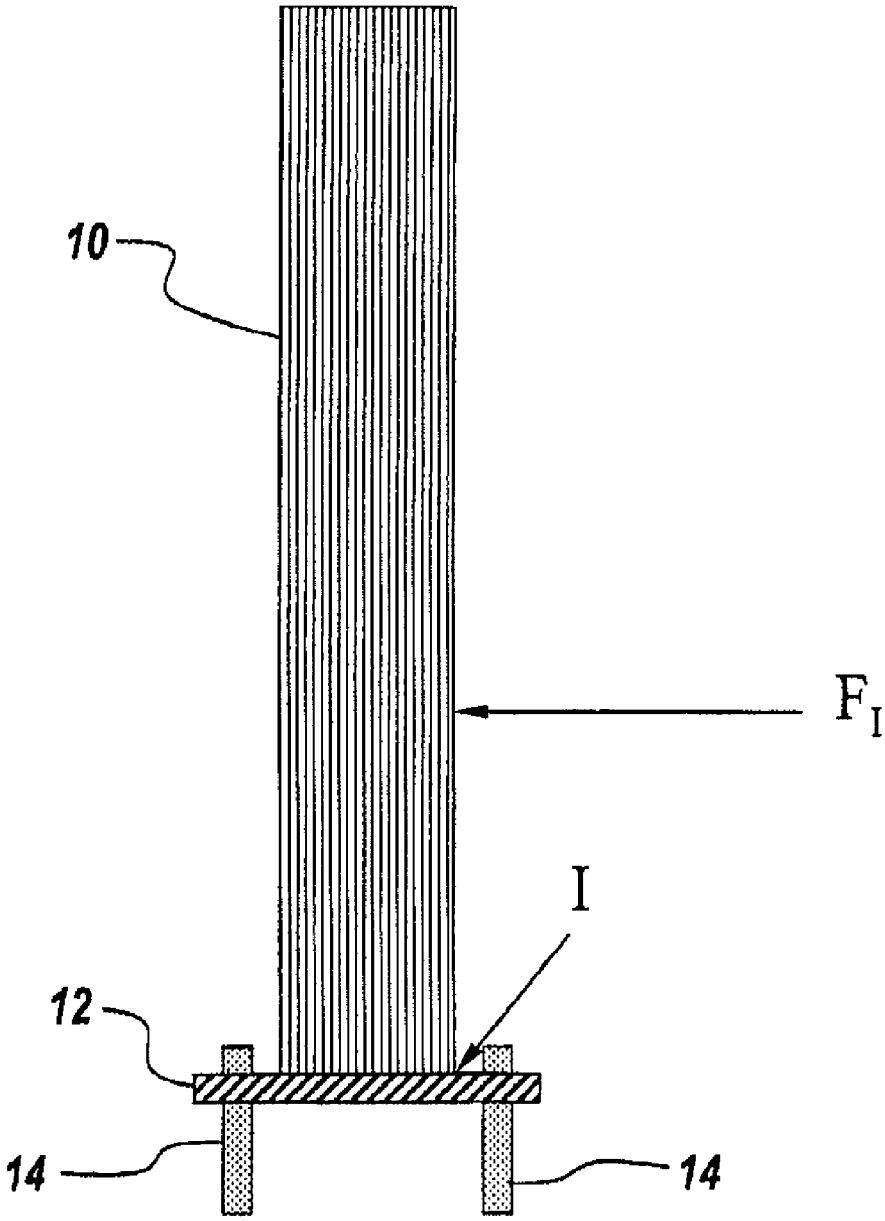
Fig. 1 (Prior Art)
FIG. 1 is a diagrammatic representation of a conventional plate-mounted bollard for purposes of illustrating the state of the art.

An illustrative embodiment of the present invention relates to a plate-mounted bollard having an internal impact absorption mechanism that enables the bollard to absorb impact forces greater than conventional plate-mounted bollards. The bollard makes use of a force transfer process that shifts impact forces to areas better able to resiliently absorb the impact forces without causing damage to the bollard, the impact absorption mechanism, or the ground in which the bollard is installed. Specifically, an internal resilient core rod is mounted to a base plate, but primarily receives impact forces at an upper and distal end of the rod from the typical area of impact. With energy from the impact force being distributed along the maximum length of the resilient core rod, the rod elastically flexes and the full length of the rod is utilized to absorb the impact force and flex. As a result, reduced forces are experienced where the rod intersects with the base plate, and the bolts or other fasteners mounting the base plate to the ground also experience reduced forces compared with conventional plate-mounted bollards. With the plate-mounted bollard of the present invention, impact forces of up to about 10,000 lbs can be absorbed with less than about 3 inches of lateral movement of the top of the bollard. This represents substantially improved performance over conventional plate-mounted bollards.

FIGS. 2 through 5, wherein like parts are designated by like reference numerals throughout, illustrate example embodiments of a bollard having an impact absorption mechanism according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

Figure 2:
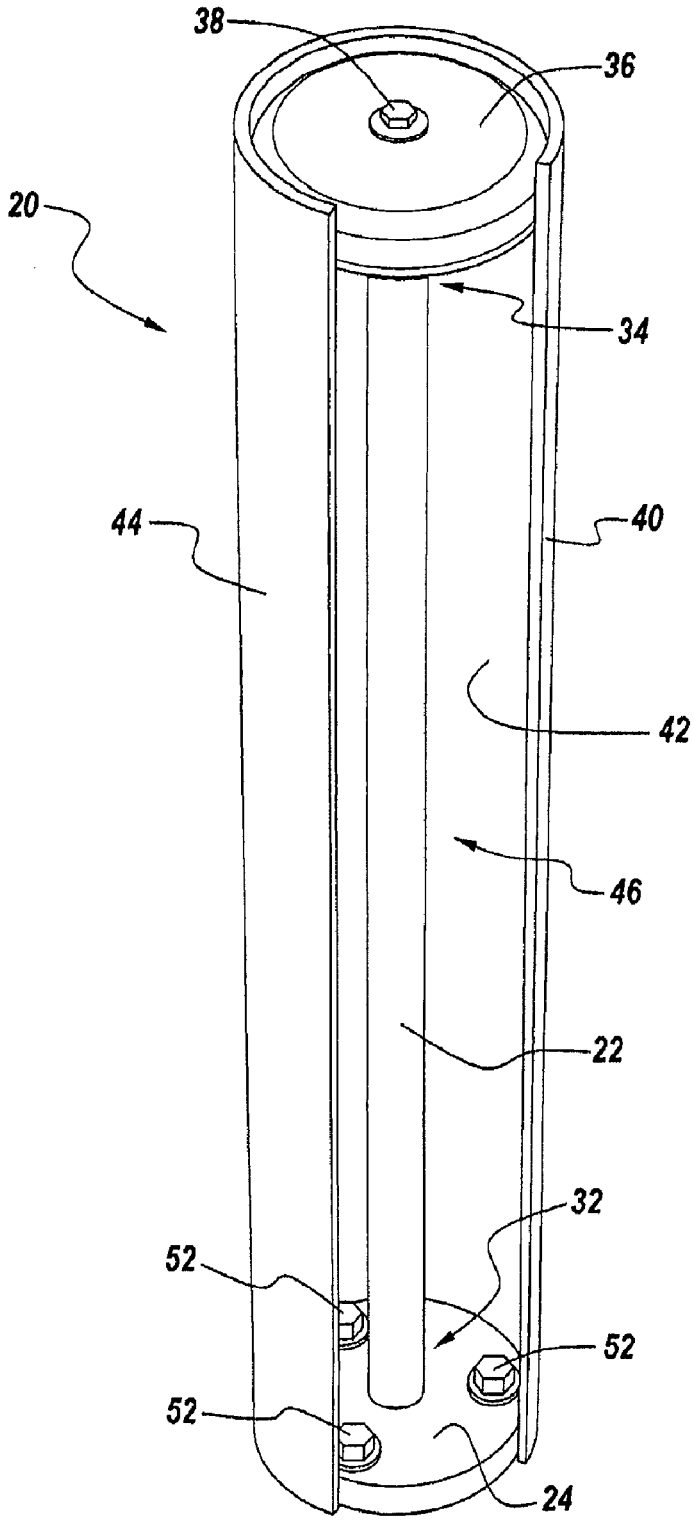
FIG. 2 is a perspective cutaway illustration of a bollard according to one embodiment of the present invention.

Turning now to a description of one example embodiment of the present invention, FIG. 2 shows a perspective view of a bollard 20. The bollard 20 includes a resilient core rod 22 extending from a base plate 24. The core rod 22 can be coupled with the base plate 24 in any number of conventional mechanisms, including press mounting, welding, threading, and the like. Alternatively, the base plate 24 can be formed of the same material and from the same integral piece of metal as the core rod 22, thereby not requiring any form of coupling mechanism or method.

Figure 4A:
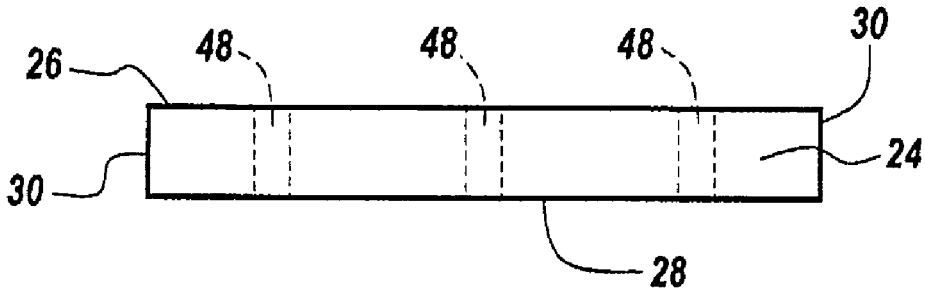
FIG. 4A is a side view of a base plate according to one embodiment of the present invention.
Figure 4B:
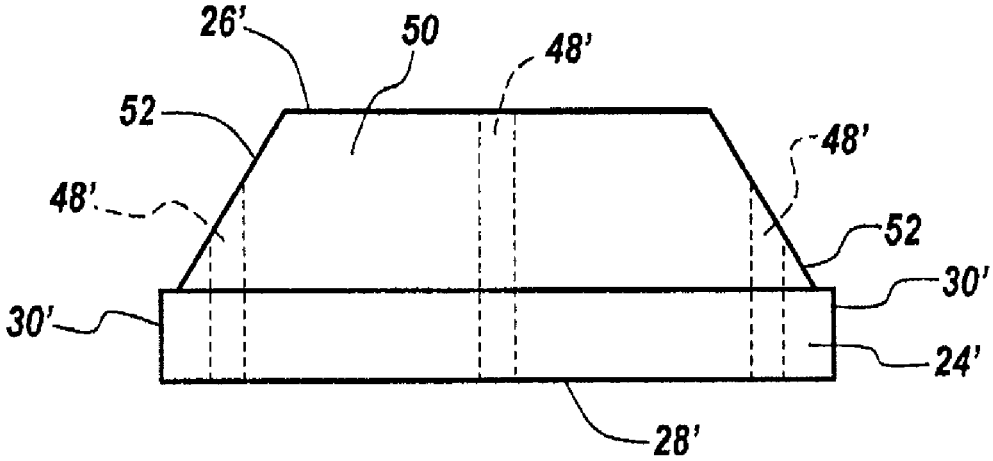
FIG. 4B is a side view of a base plate according to another embodiment of the present invention.

The base plate 24 has a top surface 26, a bottom surface 28, and a plurality of sides or edges 30 (see also FIGS. 4A & 4B). The sides or edges 30 form the perimeter of the base plate, and therefore the approximate shape of the base plate 24 (e.g., circle, square, rectangle, triangle, and the like). The base plate 24 further may include a plurality of pre-drilled holes 48 sized to receive bolts, screws, or other fasteners for mounting the base plate to the ground or floor, including to a concrete pad. Those of ordinary skill in the art will appreciate that the base plate 24 may not require the plurality of pre-drilled holes 48 if alternative mounting methods are utilized, such as for example, industrial adhesives.

FIG. 4B illustrates an alternate base plate 24' embodiment. As shown, the base plate 24' has a top surface 26', a bottom surface 28', and a plurality of sides or edges 30'. A plurality of pre-drilled holes 48' is also shown. In addition, a seating structure 50 can be incorporated with the base plate 24'. The seating structure 50 helps acts as a guide during and following an impact to the bollard 20 as described later herein.

The base plate 24 can be formed of a number of different materials, including metal, plastic, composite, and the like, so long as it is able to withstand forces resulting during impact of the bollard 20, and depending in part on the purpose of the particular bollard installation. In the example embodiment, the base plate 24 is formed of A36 steel in plate form 1 inch thick and 6 inches in diameter. Again, one of ordinary skill in the art will appreciate that the present invention is not limited to this particular illustrative embodiment.

The resilient core rod 22 has a proximal end 32 where it meets with the base plate 24, and a distal end 34 opposite the proximal end. The resilient core rod 22 is formed of a material that enables the core rod 22 to elastically flex when a lateral force is applied thereto and return to its original position when the force is removed. For example, the core rod 22 can be formed of a stainless steel having a 180 ksi yield strength and a 25-35 Mpsi modulus. The core rod 22 can have a circular cross-section with a diameter of about 1.25 inches. The core rod 22 can have a length of about 36 inches. It should be noted that these material properties and core rod dimensions are merely illustrative of an example implementation of a core rod 22 in accordance with the present invention. The bollard 20 of the present invention is by no means limited to having a core rod 22 having the above properties and dimensions. The properties and dimensions of the core rod 22 can be modified as needed for a particular bollard installation as would be understood by those of ordinary skill in the art. Some of the parameters that will dictate the properties, shape, and dimensions of the core rod 22 include range of impact forces the core rod 22 will be required to withstand, height or other size restrictions due to a particular installation requirement, amount of lateral movement of the top and/or middle of the core rod 22 upon experiencing the maximum design impact load, and the like.

The resilient core rod 22 extends substantially perpendicularly relative to the top surface 26 of the base plate 24 in accordance with one example embodiment. There may be instances where an angled relationship is required between the resilient core rod 22 and the base plate 24, which can be accommodated.

A load ring 36 is disposed at or near the distal end 34 of the resilient core rod 22. The load ring 36 can be coupled with the resilient core rod 22 using a number of different possible conventional fastening means, including a threaded connection or a bolt passing through the load ring 36 into the distal end 34 of the resilient core rod 22, in addition to other possible coupling means and mechanisms. As depicted, a bolt and washer fastening mechanism 38 coupled with a threaded hole (not shown) in the distal end 34 of the resilient core rod 22 hold the load ring 36 to the distal end 34 of the resilient core rod 22. The load ring 36 has a total outer perimeter, or equivalent total outer diameter, which is greater than that of the core rod 22. This larger dimension relative to the resilient core rod 22 is instrumental in implementation of the present invention as discussed later herein.

The load ring 36 can be formed of a number of different materials, including metal, plastic, composite, wood, natural materials, synthetic materials, and the like. In the example embodiment illustrated, the load ring 36 is formed of a hard plastic, such as a nylon or polypropylene.

A hollow impact shell 40 is disposed to surround the resilient core rod 22 and the load ring 36. Alternatively, the load ring 36 may be integrated into the hollow impact shell 40, as depicted in a later-described embodiment. The hollow impact shell 40 has an interior surface 42 and an exterior surface 44. The hollow impact shell 40 has an internal perimeter, or equivalent total internal or inner diameter, that is greater than the outer perimeter, or equivalent total outer diameter, of the resilient core rod 22. This difference in dimensions creates a gap 46 between the hollow impact shell 40 and the resilient core rod 22. The gap 46 can vary in size, but should be sufficient to prevent the interior surface 42 of the hollow impact shell 40 from making substantial contact with the resilient core rod 22 during a maximum design impact load condition.

The hollow impact shell 40 can be a number of different shapes and sizes. The hollow impact shell 40 may be formed using a rigid material, so that maximum design impact loads do not substantially damage the hollow impact shell 40. For example, in an illustrative embodiment of the present invention, the hollow impact shell 40 is formed of a Schedule 40 pipe, 6 inches in diameter, and 36 inches tall or long.

The hollow impact shell 40 does not need to be formed of a rigid material, but can instead be formed of a material that can withstand the maximum design impact forces for the bollard 20 with no permanent deformation. For example, the hollow impact shell 40 may alternatively be made from an elastically deformable material, such as plastic. In one example embodiment, the hollow impact shell 40 is made from high density polyethylene or high density polypropylene having a thickness of about ⅜". One having ordinary skill in the art will appreciate that these are examples only, and that other types of materials and thicknesses may be selected depending on the desired characteristics of the bollard 20.

With such a construction, the bollard 20 may elastically deform on impact, thereby absorbing some of the impact force. Upon the hollow impact shell 40 receiving an impact force, the impact shell deforms in order to absorb energy from the impact force. Because the impact shell 40 elastically deforms, the impact shell 40 may absorb some of the energy of the impact. Simultaneously, energy is likewise transferred to the load ring 36, which is further transferred to the resilient core rod 22, as described herein.

Further alternatively, the hollow impact shell can experience permanent deformation upon receiving a maximum design impact force, and then be replaceable with a new hollow impact shell 40, if for some reason the particular installation environment calls for such a design.

In some embodiments, the hollow impact shell 40 is not fastened with the base plate 24, the load ring 36, or the resilient core rod 22. In fact, the hollow impact shell 40 is able to move in a longitudinal direction parallel to a central axis along a length of the resilient core rod 22 and away from the base plate 24. This ability to move relative to the base plate 24, the load ring 36, and the resilient core rod 22, enables the hollow impact shell 40 to transfer any impact force it experiences directly to the load ring 36 at the distal end 34 of the resilient core rod 22, and not directly to the resilient core rod 22 at the height or area of impact on the hollow impact shell 40. Said differently, when the hollow impact shell 40 receives an impact force (e.g., from an object colliding with the bollard 20) there is an initial lateral force applied to the edge 30 of the base plate 24, but a majority of the impact force is transferred from the hollow impact shell 40 to the load ring 36 at the distal end 34 of the resilient core rod 22. Because the resilient core rod 22 is affixed in place at its proximal end 32, the most efficient location along the resilient core rod 22 for absorbing impact force energy is at the maximum distance along its length away from the proximal end 32; this location is its distal end 34. The load ring 36 is positioned at the distal end 34 for this reason. The interior surface 42 of the hollow impact shell 40 is in contact with the load ring 36 and transfers the energy of the impact force to the load ring 36. The load ring 36 in turn transfers the energy of the impact force to the distal end 34 of the resilient core rod 22. As the resilient core rod 22 absorbs the impact force, it flexes, and the hollow impact shell slides upward along the load ring 36 and generally in a direction parallel to the longitudinal central axis of the core rod 22.

Alternatively, the hollow impact shell 40 may include an integrated load ring, as described above, while still not fastened to the base plate 24. In this embodiment, the integrated load ring may be slidably coupled to the resilient core rod 22, allowing the integrated load ring to slide up and down the resilient core rod 22. For example, slidably coupling the integrated load ring to the resilient core rod 22 may be achieved by including a hole 62 in the integrated load ring through which the resilient core rod passes. One having ordinary skill in the art will appreciate that there are a number of ways to slidably couple the integrated load ring to the resilient core rod, any of which are contemplated by the present invention. Such an embodiment is discussed below in relation to FIG. 5. In embodiments including an integrated load ring, the hollow impact shell 40 may be made from any of the materials described above, such as a rigid material or an elastically deformable material.

The hollow impact shell 40 is self seating over or on the base plate 24. Looking at FIGS. 4A and 4B, two different base plate 24 embodiments are illustrated. FIG. 4A shows the base plate 24 as depicted in other figures herein. FIG. 4B shows the alternate base plate 24' having a seating structure 50 incorporated with the base plate 24'. The hollow impact shell 40 rests on the base plate 24 or on the ground upon which the base plate 24 is mounted (as depicted in FIG. 2). Because the hollow impact shell 40 is not fastened to the base plate 24, the hollow impact shell 40 can move up and off of the base plate 24 upon experiencing a sufficient impact force. After the impact force subsides, the hollow impact shell 40 is designed to fall back down onto or over the base plate 24. In installations or environments where the hollow impact shell 40 is likely to be raised to the extent that it may not correctly self-seat over the base plate 24, but may instead be caught on an edge 30 of the base plate 24, the seating structure 50 can help the hollow impact shell to slide back down into the proper position over the base plate 24. One of ordinary skill in the art will appreciate that the seating structure 50 can have a number of different configurations, dimensions, and the like, to adapt to different installation parameters. As such, the present invention is by no means limited to the specific dimensions and configurations of the seating structure 50 illustrated herein.

It should additionally be noted that although the hollow impact shell 40 is not fastened or mounted to the base plate 24, the present invention is intended to encompass equivalent structures where the hollow impact shell 40 may be removably fastened to the base plate in a manner that still enables the hollow impact shell (or equivalent structure) to raise up and off the base plate 24 upon receiving an impact force of sufficient energy.

Figure 3:
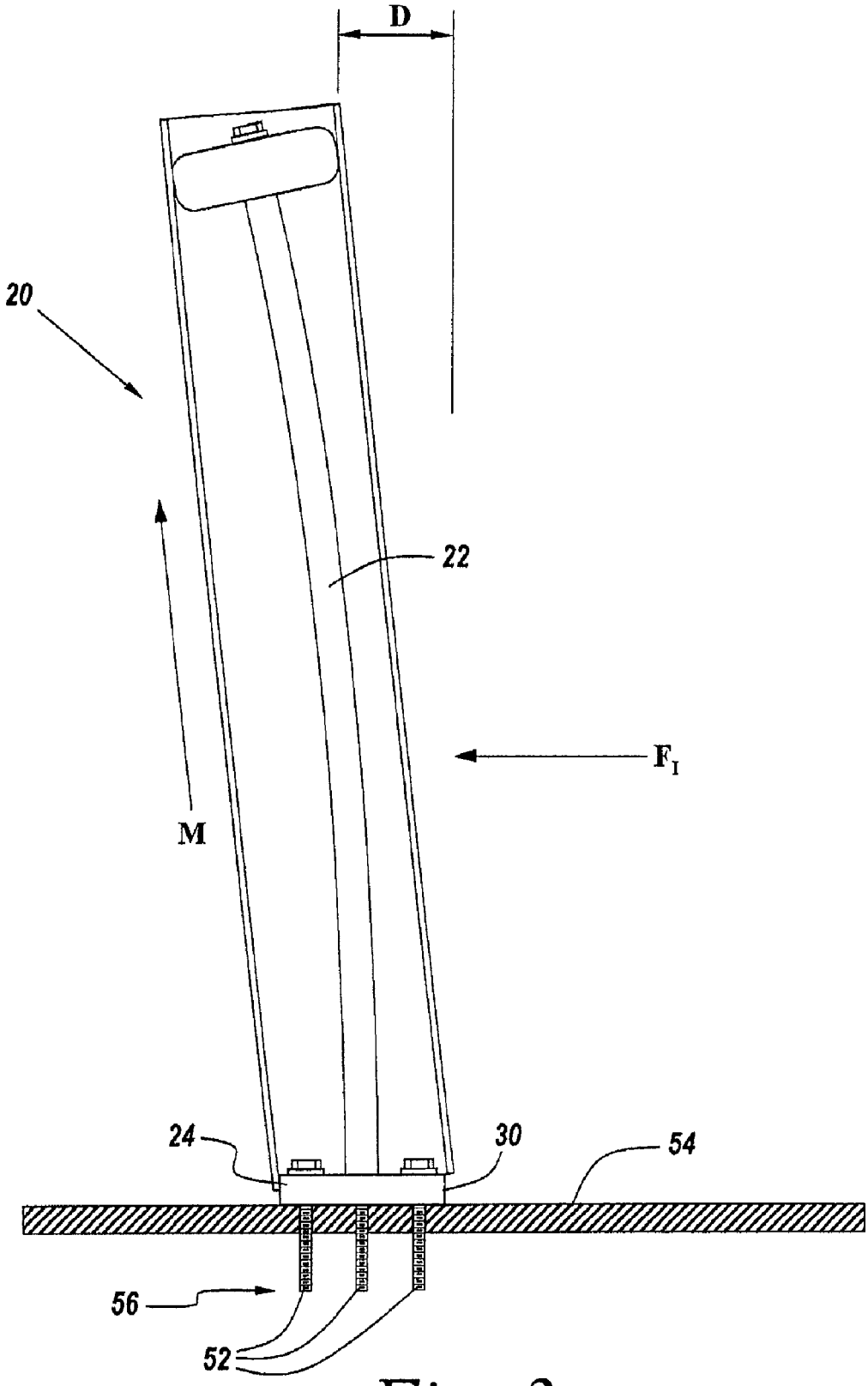
FIG. 3 is a diagrammatic representation of the bollard of FIG. 2 absorbing an impact force according to one aspect of the present invention.

In operation, as shown in FIG. 3, the bollard 20 serves to absorb an impact force as described herein. As shown, the bollard 20 is formed of the base plate 24, the resilient core rod 22, the load ring 36, and the hollow impact shell 40. The bollard 20 is mounted to the ground or floor using appropriate fasteners. For example, as shown in FIG. 3, bolts 52, such as concrete anchor bolts, mount the base plate 24 to a concrete surface 54. The concrete surface can be supported by an underlying concrete area 56, such as a concrete pad or poured concrete. In the example illustrated, the concrete area 56 is about 18 inches deep and about 1 foot in diameter.

Upon receiving an impact force ($F_1$) at the hollow impact shell 40, the energy from the impact force ($F_1$) is transferred to the load ring 36 and some initial momentum energy is transferred to the edge 30 of the base plate 24. The hollow impact shell 40 moves upward in the direction of arrow M, which is generally in a direction parallel to the central longitudinal axis of the resilient core rod 22. As the hollow impact shell 40 moves upward, some of the impact energy from the impact force ($F_1$) is absorbed in that movement. In addition, the interior surface 42 of the hollow impact shell 40 slides along the load ring 36 and through contact with the load ring 36 transfers more of the impact energy from the impact force ($F_1$) to the load ring 36. The load ring 36, being coupled with the distal end 34 of the resilient core rod 22, immediately transfers the energy from the impact force ($F_1$) to the distal end 34 of the resilient core rod 22.

The distal end of the resilient core rod 22 is the most efficient portion of the resilient core rod 22 to receive the impact force ($F_1$) in terms of its ability to absorb that energy because it is held in place at its proximal end 32 at the base plate 24. As the distal end 34 receives the energy from the impact force ($F_1$) it flexes the resilient core rod 22. As long as the impact force ($F_1$) is no greater than a maximum design load, the resilient core rod 22 will not flex at its distal end 34 in the lateral direction (D) more than a desired amount. For example, a bollard 20 having a resilient core rod 22 of stainless steel 36 inches tall with a diameter 1.25 inches within a hollow impact shell 40 of Schedule 40 pipe 6 inches in diameter receiving an impact force ($F_1$) of up to about 10,000 lbs will result in lateral movement of the distal end 34 of less than 3 inches.

As the resilient core rod 22 flexes, the existence of the gap 46 prevents the hollow impact shell 40 from actually making contact with the resilient core rod 22. This prevents the hollow impact shell 40 from directly transferring the impact load ($F_1$) to the middle or lower portions of the resilient core rod 22 and causing added stress on the intersection of the core rod 22 with the base plate 24, or on the base plate 24 and its fasteners or bolts 52.

Once the impact load ($F_1$) is removed from the bollard 20, the hollow impact shell 40 falls back down on to, or over, the base plate 24, self-seating the hollow impact shell 40 in place.

The installation of the bollard 20 of the present invention can be implemented a number of different ways depending on the particular requirements of the resultant installed bollard. One example installation method involves either beginning with a concrete floor, or creating a pad or section of concrete in a floor or ground surface that has the approximate dimensions of being about 1 foot in diameter and 18 inches deep. The base plate 24 and resilient core rod 22 are then mounted to the concrete surface using concrete anchor bolts. The load ring 36 is installed at the distal end 34 of the core rod 22. The hollow impact shell 40 is then placed over the resilient core rod 22 and the base plate 24. Installation is then complete. If desired, an additional ornamental cover (not shown) as is known in the art could be placed over the hollow impact shell 40 to improve the ornamental look of the bollard 20.

Figure 5:
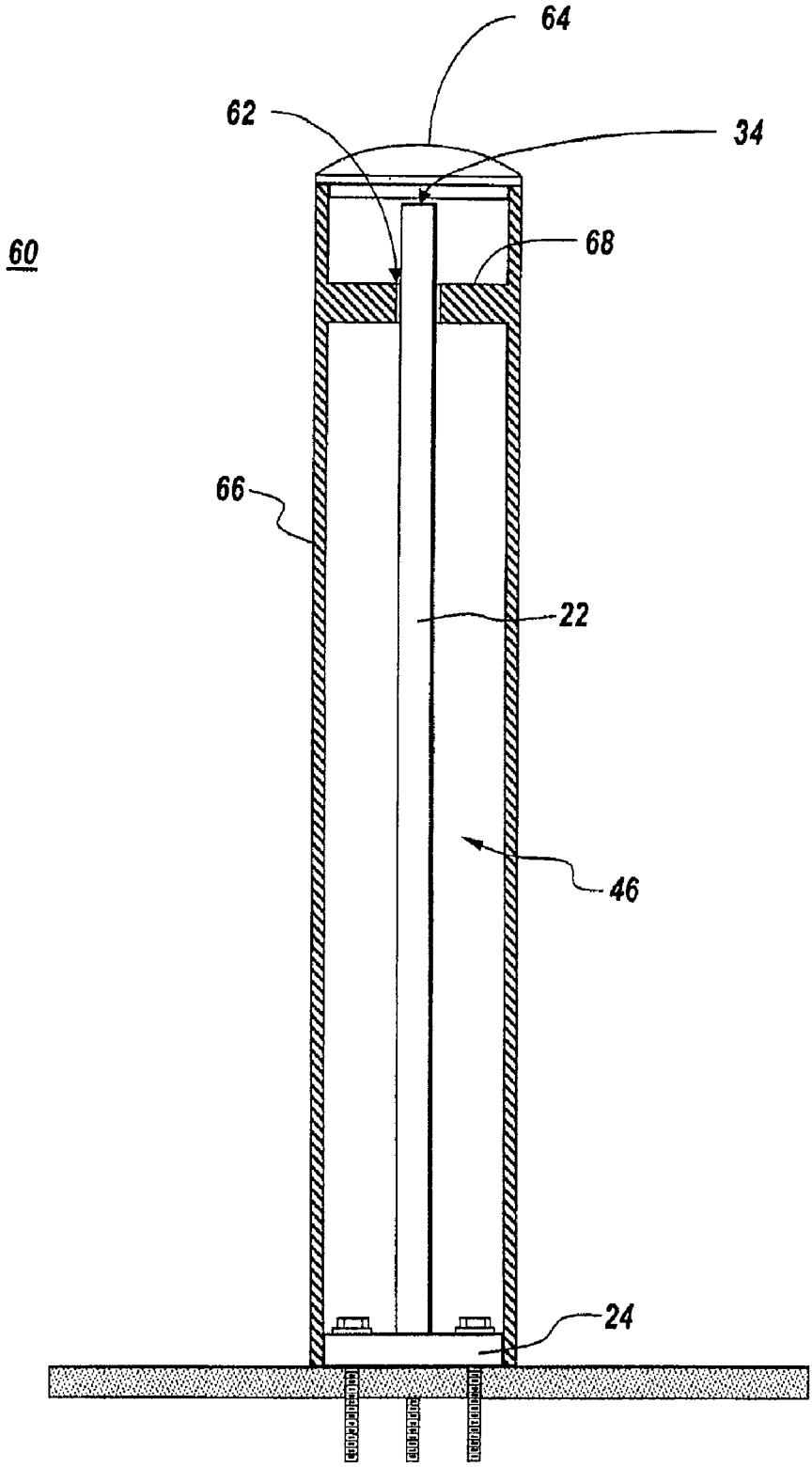
FIG. 5 is a diagrammatic representation of a bollard according to another embodiment of the present invention.

FIG. 5 depicts another embodiment of a bollard 60 according to the present invention. In this embodiment, the proximal end of a resilient core rod 22 extends from the top surface of the base plate 24. The base plate 24 is fixed to the ground as described above. A hollow impact shell 66 surrounds the resilient core rod 22. The hollow impact shell includes an integrated load ring 68, meaning that the shell and the load ring are a single structure, or are coupled together in a manner approximating a single structure. The integrated load ring includes the hole 62, through which the resilient core rod 22 passes. In this way, the distal end of the resilient core rod 22 is slidably coupled to the integrated load ring 66. As indicated previously, other slidable couplings may be utilized in such an embodiment of the present invention.

In one embodiment of the bollard depicted in FIG. 5, the hollow impact shell is made of an elastically deformable material, such as plastic. With such a construction, the bollard 60 may elastically deform on impact, thereby absorbing some of the impact force. The hollow impact shell may include a cap 64. Although the cap 64 is depicted separately in FIG. 5, one having ordinary skill in the art will appreciate that cap 64 may also be integral with the hollow impact shell, meaning that the shell 66 and the cap 64 are a single structure, or are coupled together in a manner approximating a single structure.

Upon the hollow impact shell 66 receiving an impact force, the impact shell 66 deforms in order to absorb energy from the impact force. The hollow impact shell also transfers energy from the impact force to the integrated load ring 68, which in turn transfers the impact force to the distal end of the resilient core rod 22, flexing the resilient core rod. With this configuration, the impact shell 66 does not directly transfer the impact force to the middle portion or the proximal end of the resilient core rod. Because the impact shell 66 elastically deforms, the impact shell 66 may absorb some of the energy of the impact. Simultaneously, energy is transferred to the integrated load ring 68, which is further transferred to the distal end of the resilient core rod 22, opposite the base plate 24. When the hollow impact shell 66 receives an impact force, the hollow impact shell 66 and the integrated load ring 68 together slide along the resilient core rod 22 due to the slidable coupling (hole 62) in the integrated load ring 68. This allows some of the energy of the impact to be absorbed in the movement along the resilient core rod 22, as described above in relation to FIG. 3.

With the structure depicted in FIG. 5, the bollard may have a lighter weight than a bollard with an impact shell made of a more rigid material, such as steel (but may also be made of such a rigid and heavier material, if desired). Further, because the load ring 68 is integrated into the impact shell 66, fewer parts are required, reducing the complexity and cost of the bollard. In addition, because the bollard, in some embodiments, deforms to absorb some of the energy of the impact rather than resisting the impact based on mass and rigidity alone, the bollard 60 of FIG. 5 may do less damage to an object that collides with the bollard 60 than a bollard with a rigid outer shell.

As previously indicated, the hollow impact shell 66 may constructed of a rigid material, but may include an integrated load ring 68. In such an embodiment, the integrated load ring 68 is slidably coupled to the resilient core rod 22, such as through the hole 62. Upon impact, the hollow impact shell 66 may move upward, as described above in relation to FIG. 3. Because the load ring 68 is integral with the hollow impact shell 66, the integrated load ring 68 moves upward along with the hollow impact shell 66. The integrated load ring 68 slides upward along the resilient core rod 22 through hole 62 towards the distal end 34 of the resilient core rod 22. The load ring 68, being slidably coupled with the resilient core rod 22, immediately transfers the energy from the impact force to the distal end 34 of the resilient core rod 22. As the distal end 34 receives the energy from the impact force, it flexes the resilient core rod 22, as described above in relation to FIG. 3. Once the impact load is removed from the bollard 60, the integrated load ring 68 slides downward along the resilient core rod 22 through the hole 62. Because the integrated load ring 68 is integral with the hollow impact shell 66, the hollow impact shell 66 falls back down on to, or over, the base plate 24, self-seating the hollow impact shell 66 in place.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A bollard, comprising:

a base plate having a top surface, a bottom surface on a side of the base plate opposite the top surface, and a plurality of edges defining a perimeter of the base plate:

a resilient core rod having a proximal end, a distal end, and a middle portion therebetween, the resilient core rod extending from the top surface of the base plate at the proximal end to the distal end;

a load ring disposed at or near the distal end of the resilient core rod, the load ring having a larger outer perimeter than an outer perimeter of the resilient core rod;

a hollow impact shell disposed to surround the resilient core rod and the load ring, the hollow impact shell having an interior surface and an exterior surface and being free to move relative to the load ring; and a gap between the resilient core rod and the interior surface of the impact shell;

wherein the impact shell is configured to receive an impact force and transfer the impact force to the load ring through contact with the load ring without the impact shell directly transferring the impact force to the middle portion or the proximal end of the resilient core rod, and the load ring is configured to transfer the impact force received from the impact shell to the distal end of the resilient core rod, flexing the resilient core rod.

2. The bollard of claim 1, wherein the hollow impact shell is not affixed or fastened to the base plate.

3. The bollard of claim 1, wherein the hollow impact shell is self-seating around or on the base plate.

4. The bollard of claim 1, wherein the hollow impact shell rests on or over the base plate.

5. The bollard of claim 1, wherein the hollow impact shell elevates upward upon receiving a sufficient impact force.

6. The bollard of claim 1, wherein the interior surface of the hollow impact shell is in physical contact with the load ring prior to the impact shell receiving the impact force.

7. The bollard of claim 1, wherein the hollow impact shell slides upward along the load ring upon receiving a sufficient impact force.

8. The bollard of claim 1, wherein upon the impact shell receiving the impact force, the resilient core rod flexes to absorb the impact force.

9. The bollard of claim 1, wherein upon the impact shell receiving an impact force of up to about 10,000 lbs at about 8 inches above the base plate, the distal end of the resilient core flexes in a lateral direction of less than about 3 inches.

10. The bollard of claim 1, wherein the base plate comprises a plurality of pre-drilled holes for mounting the base plate to a ground surface with fasteners.

11. The bollard of claim 1, wherein the resilient core rod is pressure fit into a hole in the base plate, or is welded to the base plate, coupling the resilient core rod with the base plate.

12. The bollard of claim 1, wherein the resilient core rod extends substantially perpendicularly from the base plate.

13. The bollard of claim 1, wherein the hollow impact shell comprises a pipe.

14. The bollard of claim 1, further comprising an elevated lip extending from the base plate into the proximal end of the hollow impact shell to guide the impact shell while elevated after impact.

15. The bollard of claim 1, wherein the gap between the resilient core rod and the interior surface of the impact shell exists at all locations of the resilient core rod.

16. The bollard of claim 1, wherein impact shell is movable relative to the base plate, resilient core rod and load ring.

17. A method of absorbing an impact using a bollard, the method comprising:

providing a bollard, comprising:

a base plate having a top surface, a bottom surface on a side of the base plate opposite the top surface, and a plurality of edges defining a perimeter of the base plate:

a resilient core rod having a proximal end, a distal end, and a middle portion therebetween, the resilient core rod extending substantially perpendicularly from the top surface of the base plate at the proximal end to the distal end;

a load ring disposed at or near the distal end of the resilient core rod, the load ring having a larger outer perimeter than an outer perimeter of the resilient core rod;

a hollow impact shell disposed to surround the resilient core rod and the load ring, the hollow impact shell having an interior surface and an exterior surface and being free to move relative to the load ring; and a gap between the resilient core rod and the interior surface of the impact shell;

the bollard receiving an impact at the impact shell;

the impact shell transferring the impact force to the load ring through contact with the load ring;

the load ring transferring the impact force to the distal end of the resilient core rod without the impact shell directly transferring lateral impact force to the middle portion of the resilient core rod; and the resilient core rod flexing in response to the impact force applied at its distal end.

18. A bollard, comprising:

a base plate having a top surface, a bottom surface on a side of the base plate opposite the top surface, and a plurality of edges defining a perimeter of the base plate:

a resilient core rod having a proximal end, a distal end, and a middle portion therebetween, the resilient core rod extending from the top surface of the base plate at the proximal end to the distal end;

a hollow impact shell disposed to surround the resilient core rod, the hollow impact shell having an interior surface and an exterior surface and being free to move relative to the resilient core rod;

a load ring integrated into the hollow impact shell and disposed at or near the distal end of the resilient core rod, the load ring having a larger outer perimeter than an outer perimeter of the resilient core rod; and a gap between the resilient core rod and the interior surface of the impact shell;

wherein the impact shell is configured to deform in order to at least partially absorb energy from an impact force, and to transfer energy from the impact force to the load ring, the load ring is configured to transfer the impact force received from the impact shell to the distal end of the resilient core rod, and flex the resilient core rod.

19. The bollard of claim 18, wherein the hollow impact shell is made of an elastically deformable material.

20. The bollard of claim 18, wherein the load ring integrated into the hollow shell is slidably coupled to the resilient core rod.

* * * * *